US011506204B2

(12) United States Patent
Meinig

(10) Patent No.: US 11,506,204 B2
(45) Date of Patent: Nov. 22, 2022

(54) GAS PUMP WITH PRESSURE RELIEF FOR REDUCING THE STARTING TORQUE

(71) Applicant: Schwäbische Hüttenwerke Automotive GmbH, Aalen-Wasseralfingen (DE)

(72) Inventor: Uwe Meinig, Bad Saulgau (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 14/151,129

(22) Filed: Jan. 9, 2014

(65) Prior Publication Data

US 2014/0199199 A1 Jul. 17, 2014

(30) Foreign Application Priority Data

Jan. 14, 2013 (DE) ..... 10 2013 200 410

(51) Int. Cl.
*F04C 27/02* (2006.01)
*F04C 15/00* (2006.01)
(Continued)

(52) U.S. Cl.
CPC ..... *F04C 27/02* (2013.01); *F04B 53/16* (2013.01); *F04C 15/0088* (2013.01);
(Continued)

(58) Field of Classification Search
CPC ..... F04C 27/02; F04C 15/0088; F04C 18/34; F04C 28/265; F04C 25/02; F04C 28/06;
(Continued)

(56) References Cited

U.S. PATENT DOCUMENTS 1,679,620 A * 8/1928 Moore ..... F16B 5/0266 40/584
2,558,837 A * 7/1951 Frei ..... F04C 28/265 418/135

(Continued)

FOREIGN PATENT DOCUMENTS

CA 2575780 A1 1/2006
DE 10 2012 222 753 A1 6/2014

(Continued)

OTHER PUBLICATIONS

Office Action dated Dec. 12, 2013 issued for German Patent Appln. No. 10 2013 200 410.9 (5 pages)—with English translation.

(Continued)

*Primary Examiner* — Philip E Stimpert
*Assistant Examiner* — Dnyanesh G Kasture
(74) *Attorney, Agent, or Firm* — RatnerPrestia

(57) ABSTRACT

A gas pump including a delivery chamber with an inlet and an outlet for a gas. The delivery chamber is at least partially enclosed by a first housing part with a first sealing surface and a second housing part with a second sealing surface. A delivery device is moveable within the delivery chamber for delivering the gas. A pressing device presses one of the housing parts against the other with a pressing force such that the sealing surfaces abut each other and together form a sealing join which at least partially surrounds the delivery chamber in order to seal off the delivery chamber. The second housing part can be moved relative to the first housing part, against the pressing force, in order to be able to widen the sealing join to form a relieving gap through which liquid situated in the delivery chamber can escape.

27 Claims, 7 Drawing Sheets

(51) Int. Cl.

| | |
|---|---|
| ***F04C 25/02*** | (2006.01) |
| ***F04C 28/06*** | (2006.01) |
| ***F04C 28/26*** | (2006.01) |
| ***F04C 18/344*** | (2006.01) |
| ***F04B 53/16*** | (2006.01) |
| ***F04C 18/34*** | (2006.01) |

(52) U.S. Cl.
CPC ..... *F04C 18/34* (2013.01); *F04C 18/3442* (2013.01); *F04C 25/02* (2013.01); *F04C 28/06* (2013.01); *F04C 28/265* (2013.01)

(58) Field of Classification Search
CPC ..... F04C 18/3442; Y10T 24/44769; Y10T 24/44778
USPC ..... 418/102, 131, 133, 135
See application file for complete search history.

(56) References Cited

U.S. PATENT DOCUMENTS 2,765,745 A * 10/1956 Sadler ..... F04C 14/265 418/135
2,997,957 A * 8/1961 Hall ..... F04D 7/02 222/385
3,041,979 A * 7/1962 McLean ..... F04C 15/00 418/133
3,193,190 A * 7/1965 Lindberg ..... F04C 18/344 418/86
3,384,296 A * 5/1968 Kahane ..... F04D 29/083 415/113
3,865,515 A 2/1975 Allen
5,239,972 A * 8/1993 Takeyama ..... F01M 13/0416 123/41.86
5,601,398 A * 2/1997 Treiber ..... F02M 37/048 415/140
6,345,600 B1 * 2/2002 Schneider ..... F01C 21/08 123/196 R
8,651,843 B2 * 2/2014 Schultz ..... F01C 21/08 418/110
2007/0059187 A1 * 3/2007 Lo Biundo ..... F01M 1/02 417/364
2007/0243081 A1 * 10/2007 Sato ..... F04C 14/18 417/310
2009/0297376 A1 * 12/2009 Figoni ..... F04C 29/128 418/1
2010/0092323 A1 * 4/2010 Ohtahara ..... F04C 18/3441 418/83
2010/0150760 A1 * 6/2010 Yamamoto ..... F04C 18/126 418/9
2010/0239440 A1 * 9/2010 Heaps ..... F04C 18/3442 417/364
2012/0060683 A1 * 3/2012 Peters ..... F04C 18/3442 91/468
2013/0017112 A1 * 1/2013 Kinch ..... F04C 2/3442 418/27
2013/0022485 A1 * 1/2013 Hunter ..... F04C 2/344 418/3
2013/0048102 A1 * 2/2013 Hagita ..... F04B 39/121 137/343
2014/0161645 A1 6/2014 Bohner et al.

FOREIGN PATENT DOCUMENTS

EP 1766239 A1 3/2007
GB 2092673 A 8/1982
JP 10-009166 1/1998
JP WO 2012032967 A1 * 3/2012 ..... F04B 39/121

OTHER PUBLICATIONS

Office Action dated Nov. 28, 2016 in corresponding German patent application.
Office Action dated Nov. 30, 2016 in corresponding Chinese patent application.

* cited by examiner

Figure 6
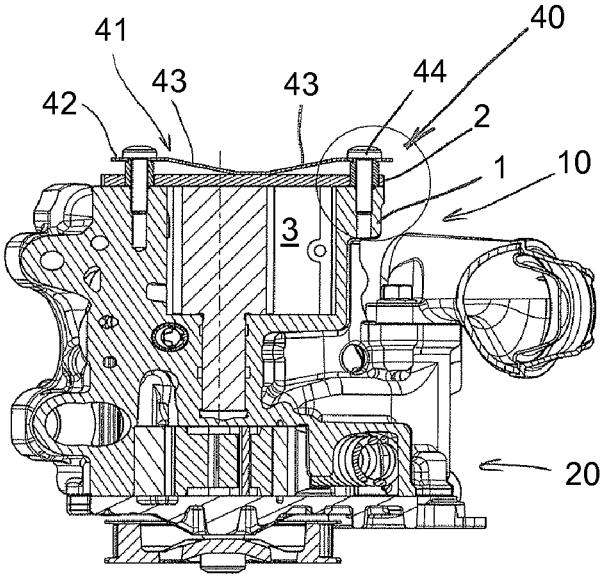
Figure 7
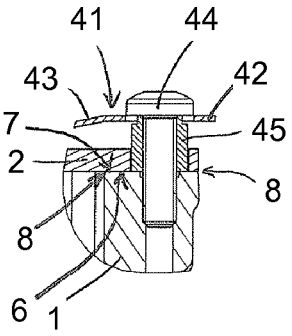
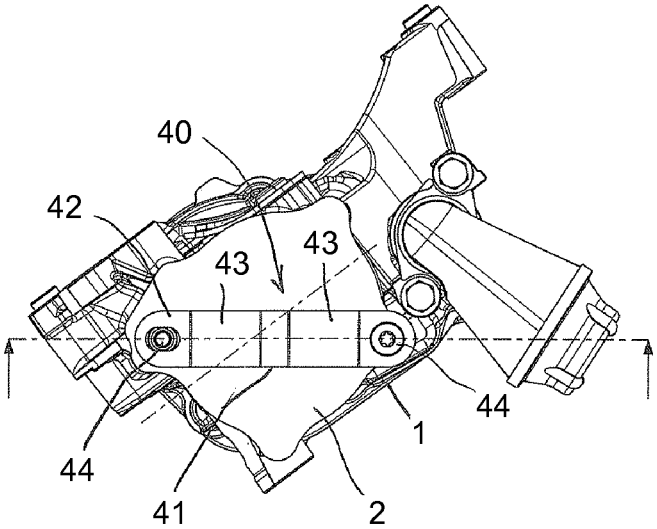
Figure 8

Figure 9
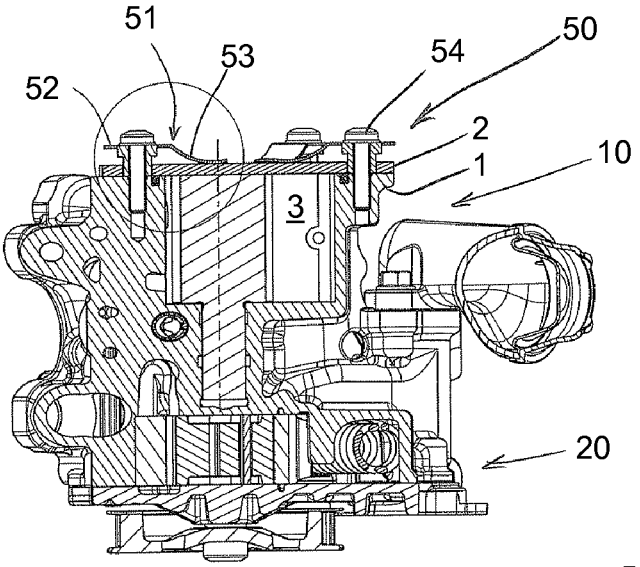
Figure 10
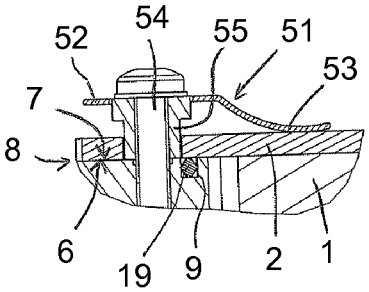
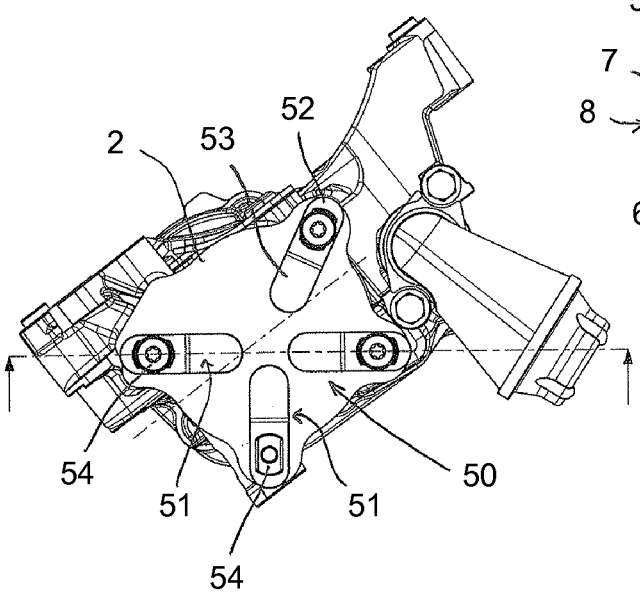
Figure 11

Figure 15
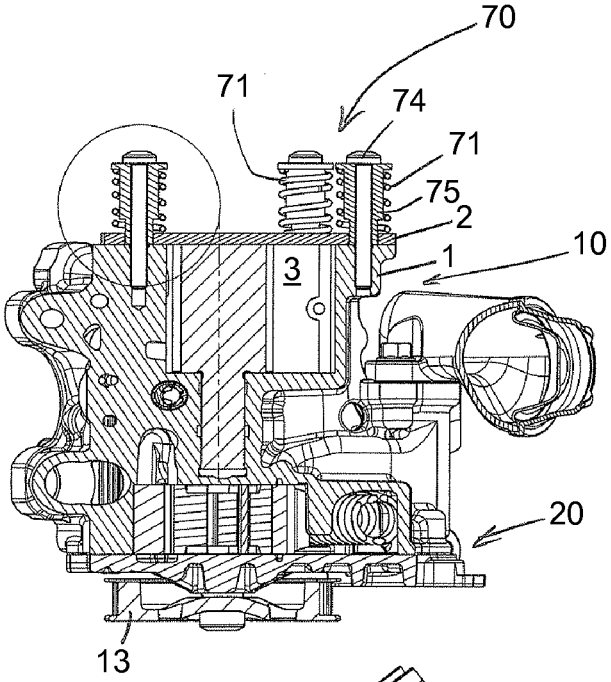
Figure 16
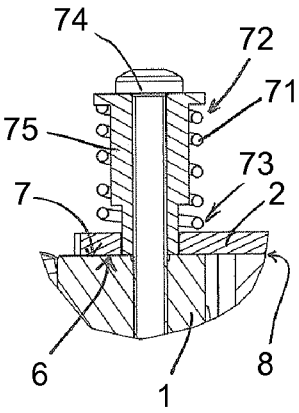
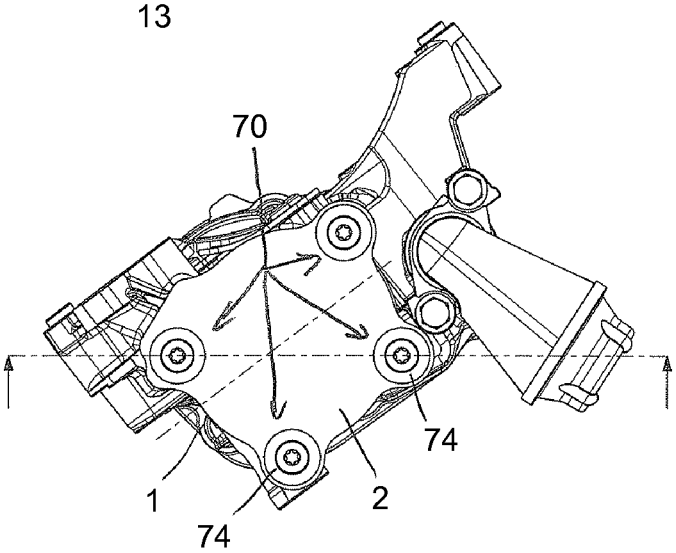
Figure 17

GAS PUMP WITH PRESSURE RELIEF FOR REDUCING THE STARTING TORQUE

This application claims priority to German Patent Application No. 10 2013 200 410.9, filed on Jan. 14, 2013, the contents of which are incorporated herein by reference.

FIELD OF THE INVENTION

The invention relates to a pump for delivering a gas which is also referred to in the following as a gas pump and can in particular be a negative pressure pump. In the case of such pumps, the invention aims to reduce forces or torques which act on the delivery device of the pump when the pump is started.

BACKGROUND OF THE INVENTION

Negative pressure pumps may be used in vehicles, for example, to provide negative pressure for a brake servo. The pump can be arranged laterally on the cylinder head of a vehicle engine and driven by a cam shaft of the engine, as has been typical for a long time. Due to design space restrictions and also in order to reduce the specific design size, as well as with regard to pedestrian protection and also cost, the negative pressure pump has in more recent times been arranged in the oil sump of the lubricating oil system, in tandem arrangement with a lubricating oil pump which supplies the vehicle engine with lubricating oil, wherein the lubricating oil pump and the negative pressure pump are typically combined in a common housing, and wherein the two pumps have a common shaft in most applications. These modules, referred to as tandem or duo pumps, are in most cases driven from the crankshaft via a traction drive or spur wheels. In particular when the negative pressure pump is arranged in the oil sump, though in principle also when it is arranged differently, the problem exists that when the engine is started and within about the first half-revolution of the negative pressure pump, the engine oil—which is particularly viscous at this time—has to be delivered relatively quickly from the delivery chamber of the negative pressure pump. This results in high drive torques of the negative pressure pump, such that there is a danger of the delivery device, for example a vane of the negative pressure pump, being destroyed or otherwise damaged by being overloaded or of damage being caused in the drive train of the negative pressure pump. A comparable problem results when a negative pressure pump which is filled with oil is rotated backwards, for example when an automobile with its engine switched off rolls backwards from a car transporter when the transporter is being unloaded, and the vehicle which is still rolling is slowed by putting the switched-off engine in gear.

In order to avoid said damage to the delivery device of the negative pressure pump and its drive, such negative pressure pumps are generally fitted with reverse rotary valves. It is likewise typical, in order to avoid inadmissibly high drive moments of the negative pressure pump when it is embodied as a vane cell pump, to provide the pump vane or vanes with a sufficiently large radial clearance with respect to the inner contour of the pump housing, at least in the rotational angular ranges of the pump rotor which are critical in this respect. This provision enables a part of the oil, which is still situated in the delivery chamber when the engine is started, to flow past the front face of the vane during the first revolution of the negative pressure pump. In order to prevent or hinder the delivery chamber from being filled with oil after the drive motor has been turned off, the pumps—in particular, negative pressure pumps arranged in the oil sump—are provided with oil retention valves. Another countermeasure for said problem is to purposefully provide an inlet valve or outlet valve of the negative pressure pump with a leak and so quickly relieve the negative pressure which still exists in the delivery chamber after the negative pressure pump has been stopped. Solutions in this respect are disclosed in US 2012/0060683 A.

Said provisions do however have the disadvantage either that they are associated with additional design outlay and therefore cost for the negative pressure pump or that the evacuating rate and therefore the effectiveness of the pump are reduced. Given the constraint of equal evacuating rates, a reduction in the effectiveness of the pumps is synonymous with an increase in the drive rates for the negative pressure pumps, resulting in a rise in the fuel consumption and correspondingly the CO2 emissions of the vehicles.

SUMMARY OF THE INVENTION

It is an object of the invention to reduce the forces or moments acting on a delivery device of a gas pump when the gas pump is started, in a way which is cost-effective, reliable and simple in design, and advantageously without the solution in accordance with the invention impairing the delivery rate of the pump.

The invention proceeds from a gas pump which comprises: a first housing part comprising a sealing surface; a second housing part, likewise comprising a sealing surface; a delivery chamber comprising an inlet and an outlet for a gas; and a delivery device, which can be moved within the delivery chamber, for delivering the gas. The two housing parts alone can together form the delivery chamber and can in particular completely enclose the delivery chamber, aside from one or more inlets and one or more outlets. It is however in principle also possible for the first housing part and the second housing part to enclose the delivery chamber only in concert with one or more other housing parts of the gas pump. One of the housing parts, for example the second housing part, can in particular be a housing cover which seals off the delivery chamber on one front face. The housing parts are joined to each other such that they surround the delivery chamber over a circumference of the chamber, at least partially and preferably completely, and such that their sealing surfaces mentioned abut each other, forming a sealing join, in order to seal off the delivery chamber along the circumference of the chamber over the length of the sealing join. When joined, the sealing surfaces are pressed against each other.

In order to reduce the forces or moments acting on the delivery device when the gas pump is started, the second housing part can be moved relative to the first housing part, against a pressing force with which the two housing parts are pressed against each other in the region of the sealing join, in such a way that the sealing join can be widened. Widening the sealing join forms a relieving gap through which liquid situated in the delivery chamber, such as in particular lubricating fluid, can escape. The pressing force is generated by means of a pressing device which presses the sealing surfaces of the two housing parts against each other. The pressing device is configured such that the pressing force of the pressing device is reached when a maximum pressure which prevails in the delivery chamber and acts on the second housing part is reached, and the pressing force of the pressing device is exceeded when the pressure in the chamber increases further, such that the widening movement of the second housing part and the associated widening of the sealing join begins. The maximum pressure is determined by the pressing device. The pressing device can be configured such that said widening movement proceeds gradually in accordance with a positive pressure which prevails in the delivery chamber relative to the outside environment of the housing parts, or abruptly when a predefined maximum positive pressure is exceeded. The relieving gap which is formed in this way can correspondingly be gradually or abruptly closed again when the pressure in the delivery chamber is reduced, and the sealing join can thus be restored by the pressing force of the pressing device.

The second housing part can be planar on a lower side which limits the front face of the delivery chamber and comprises the second sealing surface. In a further simplification, the whole of the second housing part can be formed as a plate, preferably a thin plate. It can in particular exhibit a wall thickness of at most a few millimeters and preferably between 1 and 6 mm. The second housing part can advantageously be a sheet of metal, preferably steel, and can in particular be punched to form a punched part or formed by another separating process.

The gas pump is preferably embodied as a negative pressure pump and serves to supply one or more assemblies, preferably one or more assemblies of a motor vehicle, with negative pressure or is provided for such an application. One application which the invention caters to is that of a vacuum pump for supplying a brake servo or other assembly of a motor vehicle with negative pressure. The invention is not however restricted to such applications; the gas pump can in principle also serve to supply one or more assemblies with pressurised gas. The gas can be air, but can in principle also be another gas.

The gas pump can be embodied as a rotary pump. In such embodiments, the delivery device as viewed in its entirety can be rotatable about a rotational axis in the delivery chamber or can comprise at least one delivery member which can be rotated about a rotational axis in the delivery chamber. The delivery device can also comprise a plurality of delivery members which can be rotated about rotational axes which are spaced from each other. The gas pump can in particular be a vane cell pump, and the delivery device can correspondingly comprise one or more delivery rotors which each comprise one or more vanes.

If the gas pump is a negative pressure pump, the negative pressure which prevails in the delivery chamber relative to the environment of the gas pump during pump operations advantageously assists the pressing force. If the gas pump is arranged in a negative pressure system, the inlet of the delivery chamber is connected to an assembly which is to be supplied with the negative pressure. The outlet of the delivery chamber can be connected to the environment, in order to expel the suctioned gas into the environment. However, the outlet of the delivery chamber can instead also be connected to another assembly, in order to supply the latter with the gas delivered by the gas pump. As mentioned, however, the invention is in principle not restricted to negative pressure pumps. If the gas pump generates a positive pressure in the delivery chamber during normal pump operations, the pressing device should be configured to generate a correspondingly larger pressing force, such that the pressing force ensures the necessary seal at the sealing join. However, in the case of negative pressure pumps in particular, there is a danger of fluid, such as in particular lubricating fluid which serves to lubricate and seal off the gas pump, penetrating into the delivery chamber due to a negative pressure which still prevails in the delivery chamber immediately after the pump is stopped, wherein this penetrating excess fluid has to be discharged by means of the delivery device when the gas pump is started. The pressing device is advantageously configured for this load scenario with regard to the pressing force which it generates.

If the sealing join opens liquid situated in the delivery chamber escapes through the relieving gap preferably into the environment of the gas pump from where the liquid can for example flow into a reservoir for the liquid. In such embodiments the relieving gap connects the delivery chamber with the environment of the gas pump or a reservoir for the liquid. The relieving gap so to say short circuits the delivery chamber to the environment of the gas pump or the liquid reservoir. In embodiments in which the liquid is a lubricating oil for a combustion engine e.g. the motor oil for lubricating an internal combustion motor, the relieving gap connects the delivery chamber with the lubricant sump or motor oil sump of the engine or motor, the motor preferably being a drive motor for driving a vehicle. Because of the connection with the environment or the liquid reservoir, into which the liquid from the delivery chamber can escape, power losses are reduced. There is no power wasted for feeding the excess liquid, for example in a circular motion around a pump rotational axis if the gas pump is a rotary pump.

In preferred embodiments, the pressing device generates a spring force which forms at least a part of the pressing force. The pressing device can generate the whole of the pressing force as a spring force. In principle, however, embodiments can also be realised in which the pressing device only generates a part of the pressing force as a spring force and generates the remaining part in another way, for example by means of an electric or hydraulic drive. Generating the pressing force in the form of a spring force, however, enables embodiments of the pressing device which are simple in design, cheap and particularly functionally reliable. On the other hand, the possibility of the pressing device generating the pressing force not as a spring force but rather only in another way, such as for example electrically or hydraulically, should not be excluded. Such embodiments, however, have the disadvantage that the second housing half has to be actively moved in order to widen the sealing join by means of the pressing device. The spring force of the pressing device acts counter to the widening of the sealing join and thus acts as a restoring force which closes the relieving gap when the pressure in the delivery chamber abates, either in combination with an additional force applied in another way by the pressing device or preferably on its own.

If the pressing device generates at least a part of the pressing force as a spring force, it is advantageous if the pressing device is elastically flexible over a spring path which is at least as large as a maximum gap width of the relieving gap. This applies both to embodiments in which the pressing force is generated exclusively as a spring force, as is preferred, and to embodiments in which the pressing device applies a spring force in combination with an additional force in order to keep the sealing join closed.

In order to limit the movement of the second housing part in a direction which widens the sealing join and thus limit the gap width of the relieving gap, an abutment can be provided, against which the second housing part comes to rest in contact in an end position which corresponds to the maximum widening. Alternatively, the widening movement of the second housing part can be limited by a spring force which acts counter to the widening and increases with the widening, wherein this spring force which serves to limit the movement can in particular be the pressing force or a part of the pressing force. If the pressing device comprises one or more spring members for generating said spring force, then such a spring member or one or more or all of the plurality of spring members respectively can not only generate a restoring spring force but also, in an additional function, form a fixed abutment which limits the movement of the second housing part.

Although the pressing device for generating the pressing force can in principle be supported on a support device which is external with respect to the gas pump, embodiments in which the pressing device is supported only on the gas pump or a mounting unit which comprises the gas pump, such as for example a pump unit which comprises the gas pump and a liquid pump, are preferred. The pressing device for generating the pressing force is particularly expediently supported on the first housing part on the one hand and on the second housing part on the other hand, such that the reaction forces which occur when the second housing part is pressed are absorbed by both these housing parts.

In embodiments in which the pressing device generates the pressing force partially or completely in the form of a spring force, the pressing device comprises at least one spring member which generates the spring force on its own or in combination with one or more optional other spring members of the pressing device. The at least one spring member can in particular be a flexurally stressed spring or a torsionally stressed spring. Disc springs or membrane springs or in particular leaf springs and sinuous springs can for example be used as flexurally stressed springs, while helical pressure springs are preferred torsionally stressed springs. If the pressing device comprises two, three or more spring members, then what has been said applies to each of the plurality of spring members. If a plurality of spring members are provided, they can in principle also be embodied differently with regard to stress or shape; both a flexurally stressed spring and a torsionally stressed spring, or different types of leaf springs, can for example be provided. A flexurally stressed spring member can be manufactured very simply from a metal spring sheet, and its shape adapted to the geometrical conditions at its point of installation, using a separating process, in particular punching, in combination with at least one reshaping process.

The one or more spring members each comprise a spring support region and a spring coupling region. The respective spring member is supported in the spring support region and coupled to the second housing part in the spring coupling region. In the spring coupling region, it preferably acts on the second housing part in the direction of the pressing force. In embodiments which are simple in design and not least for this reason preferred, it acts directly on the second housing part in the spring coupling region. It can thus for example press directly against the second housing part, preferably in the direction of the pressing force. In principle, however, it is also possible to realise an indirect coupling. If indirectly coupled, the spring member acts on the second housing part via one or more transmission elements, preferably with no deflecting element. In its spring support region, the respective spring member can be supported externally in relation to the gas pump. In its spring support region, however, the respective spring member can in particular be supported on the first housing part, as applicable on a third housing part of the gas pump if one is provided. In an embodiment which is simple and not least for this reason preferred, the respective spring member is supported directly on the first housing part, such that the support does not require any transmission element but rather only a corresponding support engagement and preferably simultaneously also a holding engagement, directly from the spring member and first housing part. In alternative embodiments, the respective spring member can be supported on the first housing part via an additional fastening element such as for example a screw element or extrusion bolt element. Such embodiments are also expedient.

The one or more spring members of the pressing device can each be produced separately from the first housing part and second housing part and can be coupled to at least the second housing part and supported on the first housing part in order to generate the pressing force or at least a part of the pressing force. In alternative embodiments, the one or more spring members of the pressing device can instead also be formed in one piece with the first housing part or preferably the second housing part, for example in a casting or sintering process, or can be fixedly joined to the first housing part or preferably the second housing part, to form a unit. It/they is/are particularly expediently formed from a sheet of metal, in particular steel. The housing part comprising the one or more integrated spring members can then for example be obtained by punching, to form a punched metal sheet part, or by means of another separating process. In such embodiments, the housing part which comprises the one or more spring members integrated in this way—preferably, the second housing part—can comprise a housing part base structure and either just one or a plurality of spring members which each project from said housing part base structure and jointly generate at least a part of the pressing force. The housing part base structure comprises the sealing surface of the relevant housing part and can in particular form the part of the relevant housing part which surrounds the delivery chamber. The housing part base structure from which the one or more spring members each project is advantageously rigid in its own right and at least significantly more rigid than the spring member(s), such that it is not deformed at least in the region of the sealing surface.

If a plurality of integrated spring members are provided, they can each project in the form of a spring arm, in particular along a periphery of the housing part base structure. The one or more integrated spring members can each be straight or bent. Bent spring arms are preferred, since this increases the length of the respective spring arm and enables the spring force generated by the respective spring arm when the sealing join is widened to be more precisely adapted to the pressure conditions in the delivery chamber. In embodiments in which the spring arm(s) is/are straight, the respective spring arm can project outwards from the periphery of the housing part base structure, radially or advantageously in both a radial and tangential direction, as viewed in a top view onto the housing part base structure. In preferred embodiments, the respective spring arm is bent, preferably in an L-shape or C-shape, as viewed in a top view onto the housing part base structure and comprises a first spring arm portion which projects outwards from the periphery of the housing part base structure and a second spring arm portion which connects to the first spring arm portion and points at least substantially parallel to the periphery of the housing part base structure. The second spring arm portion is preferably longer than the first spring arm portion. A spring support region in which the integrated spring member is supported and preferably fastened on the first housing structure can form an end of the respective spring arm.

The integrated spring member(s) can advantageously be formed such that it is or they are each subject to a spring bias when the pump is at a stop, such that the housing part base structure and in particular the sealing surface of said housing part base structure press against the other housing part, such that the closed sealing join is obtained. If the one or more spring members is/are formed separately from the housing parts, then such a spring member is preferably also mounted with a bias, such that it is subject to a spring bias when the pump is at a stop.

The integrated spring member can in particular be embodied as a flexurally stressed spring member. If a plurality of integrated spring members are provided, this advantageously applies to each of these spring members. In embodiments comprising one or more integrated spring members, the respective spring member is fixedly connected to the housing part base structure either in the spring coupling region or in the spring support region. As mentioned, the fixed connection can be a join connection or can advantageously be obtained by forming, for example casting, the housing part base structure and the respective integrated spring member in one piece. The integrated spring member (s) can be fixedly joined to the other of the two housing parts, i.e. to either the first housing part or the second housing part, preferably by means of a releasable connection such as for example a screw connection. The housing part which comprises the one or more integrated spring members can be formed entirely in the manner of a membrane spring or disc spring, wherein advantageously the entire spring array is subjected to tensile stress and the respective spring member is subjected to bending stress when the sealing join is widened.

If the one or more spring members of the pressing device are each formed separately from the first housing part and second housing part, a fastening element such as for example a screw element can be respectively provided for fastening the respective spring member. In embodiments which are simple and not least for this reason preferred, the one or more spring members can each simultaneously also form their fastening element, such that a fastening element in addition to the respective spring member is not required. The one or more spring members can then each be formed in particular as a spring clip, such as for example a sheet metal spring clip, and can comprise one or two spring support regions with which they each encompass the mutually abutting housing parts and grip behind one of the housing parts, preferably the first housing part. The spring coupling region of the respective spring member can directly or indirectly press against the other housing part, preferably the second housing part. The respective spring member can co-operate with the two housing parts, in particular in the manner of sealing springs such as are for example known for sealing preserving jars.

In particular in embodiments in which the one or more spring members of the pressing device is/are each embodied as a leaf spring, the respective spring member can comprise a left-hand spring support region and a right-hand spring support region. In such embodiments, the spring coupling region extends between these spring support regions and connects them to each other. The spring coupling region can be formed so as to be in particular convex in relation to the second housing part and can act on the second housing part in the direction of the pressing force between the spring support regions and preferably press against the second housing part in a direct contact. The spring member is preferably offset and/or distanced slightly from the second housing part in the region of the spring support regions which are on the outside in relation to the spring coupling region, in order to enable the spring member to deflect, i.e. elastically yield, as is necessary for the widening movement of the second housing part.

In embodiments in which the one or more spring support regions of the spring member encompass the first housing part and the second housing part as described above, the respective spring support region can simultaneously also form a guide along which the second housing part is guided relative to the first housing part in a guiding engagement during the widening movement. In the guiding engagement, the respective spring support region can engage between lateral guiding elements of the second housing part. The guiding elements can be side walls of a cavity on the circumferential edge of the second housing part or can be formed by outwardly projecting protrusions of the second housing part, with or between which the spring support region—which serves as a guide—engages.

The axial clearance of one or more spring members of the delivery device is optionally limited by particular provisions. If the gas pump is embodied as a rotary pump, for example comprising one or more vanes circumferentially, and correspondingly comprises a delivery rotor, then the axial clearance of the latter can be limited by a suitable pivot bearing. If the gas pump is a vane cell pump, the one vane or as applicable the plurality of vanes can be axially secured on the delivery rotor. In conventional rotary gas pumps, the housing cover typically limits the axial clearance. If the second housing part of a rotary gas pump in accordance with the invention is a housing cover, the delivery rotor or a vane of a vane cell pump can be moved in the direction of the second housing part during a widening stroke of the second housing part. During the closing movement of the second housing part, the latter can then press against the delivery rotor or the vane, leading to wear. This can be countered by limiting the axial clearance.

The subject-matter of the invention also includes a combined gas pump and liquid pump which serves to supply an assembly with a liquid fluid, for example a liquid working fluid or a fluid lubricant, wherein in an additional function, said liquid fluid also forms the sealing fluid for the gas pump. The liquid pump can in particular be a lubricant pump for supplying a combustion engine or other assembly with liquid lubricant. The liquid pump comprises a delivery chamber, and the delivery chamber comprises an inlet on a low-pressure side of the liquid pump and an outlet on a high-pressure side of the liquid pump, for the fluid. The liquid pump also comprises a delivery device which can be driven and which can perform a delivery movement in the delivery chamber when driven, which delivers the fluid from the inlet to the outlet of the delivery chamber. The inlet can be an inlet of the liquid pump upstream of the delivery chamber or an inlet directly into the delivery chamber. The outlet can be an outlet directly out of the delivery chamber or an outlet of the liquid pump downstream of the delivery chamber. A feed can advantageously be provided in the combined gas and liquid pump, in order to connect a sealing recess of the gas pump, which is formed in the first or second sealing surface, to the low-pressure side or the high-pressure side of the liquid pump and so supply it with the liquid which serves as a sealing fluid for sealing off the sealing join in such embodiments.

The liquid pump comprises a housing part which forms one or more chamber walls of the delivery chamber of the liquid pump. One of the housing parts of the gas pump can simultaneously also form this housing part of the liquid pump. The relevant housing part can in particular comprise the first sealing surface for sealing off the delivery chamber of the gas pump.

If the gas pump and the liquid pump are rotary pumps, such that the delivery device of the gas pump and also the delivery device of the liquid pump each comprise at least one delivery member which can be rotated about a rotational axis, it is also advantageous if these delivery members are mounted such that they can be rotated about a common rotational axis. While the at least two rotatable delivery members can in principle surround each other, they are however more preferably arranged coaxially next to each other. The at least one rotatable delivery member of the gas pump and the at least one rotatable delivery member of the liquid pump can be rotatable relative to each other; in preferred embodiments, however, they are non-rotationally connected to each other. Preferably, they are jointly driven via a drive wheel, wherein they can be coupled by means of a gear system. They can in particular be arranged on a common shaft. In such embodiments, these delivery members can each be joined, fixedly in terms of torque, to the common shaft. It is also possible for one of the delivery members—either a delivery rotor of the gas pump or a delivery rotor of the liquid pump—to be formed in one piece with the shaft, and for only the other delivery rotor in each case to be non-rotationally connected to the shaft. Embodiments in which the shaft forms both a delivery rotor of the gas pump and a delivery rotor of the liquid pump in one piece are in principle also conceivable, although in many embodiments, this will only be realisable if the housing is divided in the axial direction.

Although the gas pump can be driven by a drive motor of its own, for example an electric motor, it is driven by the combustion engine in preferred example embodiments and is correspondingly connected to a shaft of the combustion engine in a way which transmits torque. The delivery device, for example a rotatable feed wheel of the gas pump, can be non-rotationally connected to a shaft of the combustion engine, i.e. can be non-rotational relative to the relevant shaft and can correspondingly be rotary-driven at the rotational speed of the relevant shaft if, as is preferred, the gas pump is a rotary pump. Alternatively, a feed wheel of the delivery device can be rotary-driven via a gear system at the same rotational speed as the machine shaft or at a rotational speed which deviates from the rotational speed of the machine shaft, i.e. via a reducing or multiplying gear system. The driving machine shaft can for example be a crankshaft or a cam shaft. The combustion engine can in particular be an internal combustion engine.

The invention does not relate only to a gas pump with pressure relief in accordance with the invention on its own and to a pump unit in which the gas pump is combined with a liquid pump of the type described in a common housing. The invention also relates to a combined gas pump and liquid pump, in particular lubricant pump, in which the two pumps comprise mutually separate pump housings, as is generally typical in motor vehicle construction, and are also generally arranged at different locations on or close to the combustion engine, wherein the gas pump is connected to the fluid circuit of the liquid pump, i.e. the liquid which is to be able to escape in accordance with the invention from the delivery chamber of the gas pump is the liquid delivered by the liquid pump. The invention also relates to a combustion engine comprising a mounted gas pump or pump unit of the type described and also to a vehicle, preferably a motor vehicle, comprising a combustion engine featuring a mounted gas pump or pump arrangement of the type described. The combustion engine can in particular form a drive motor of the vehicle. The gas pump or the pump unit can be at least partially immersed in a lubricant reservoir, in particular in embodiments in which the gas pump or pump unit is combined with a liquid pump for supplying the combustion engine with the lubricant in the pump unit described.

BRIEF DESCRIPTION OF THE DRAWINGS

The invention is described below on the basis of example embodiments. Features disclosed by the example embodiments, each individually and in any combination of features, advantageously develop the subject-matter of the invention and also the embodiments discussed above. There is shown:

FIG. 6 illustrates a pump unit comprising a gas pump of a second example embodiment, in a longitudinal section;

FIG. 7 illustrates a detail of FIG. 6 in an enlarged representation;

FIG. 8 illustrates the pump unit of the second example embodiment, in an axial view onto the gas pump;

FIG. 9 illustrates a pump unit comprising a gas pump of a third example embodiment, in a longitudinal section;

FIG. 10 illustrates a detail of FIG. 9 in an enlarged representation;

FIG. 11 illustrates the pump unit of the third example embodiment, in an axial view onto the gas pump;

FIG. 15 illustrates a pump unit comprising a gas pump of a fifth example embodiment, in a longitudinal section;

FIG. 16 illustrates a detail of FIG. 15 in an enlarged representation; and FIG. 17 illustrates the pump unit of the fifth example embodiment, in an axial view onto the gas pump.

DETAILED DESCRIPTION OF THE INVENTION

Figure 1:
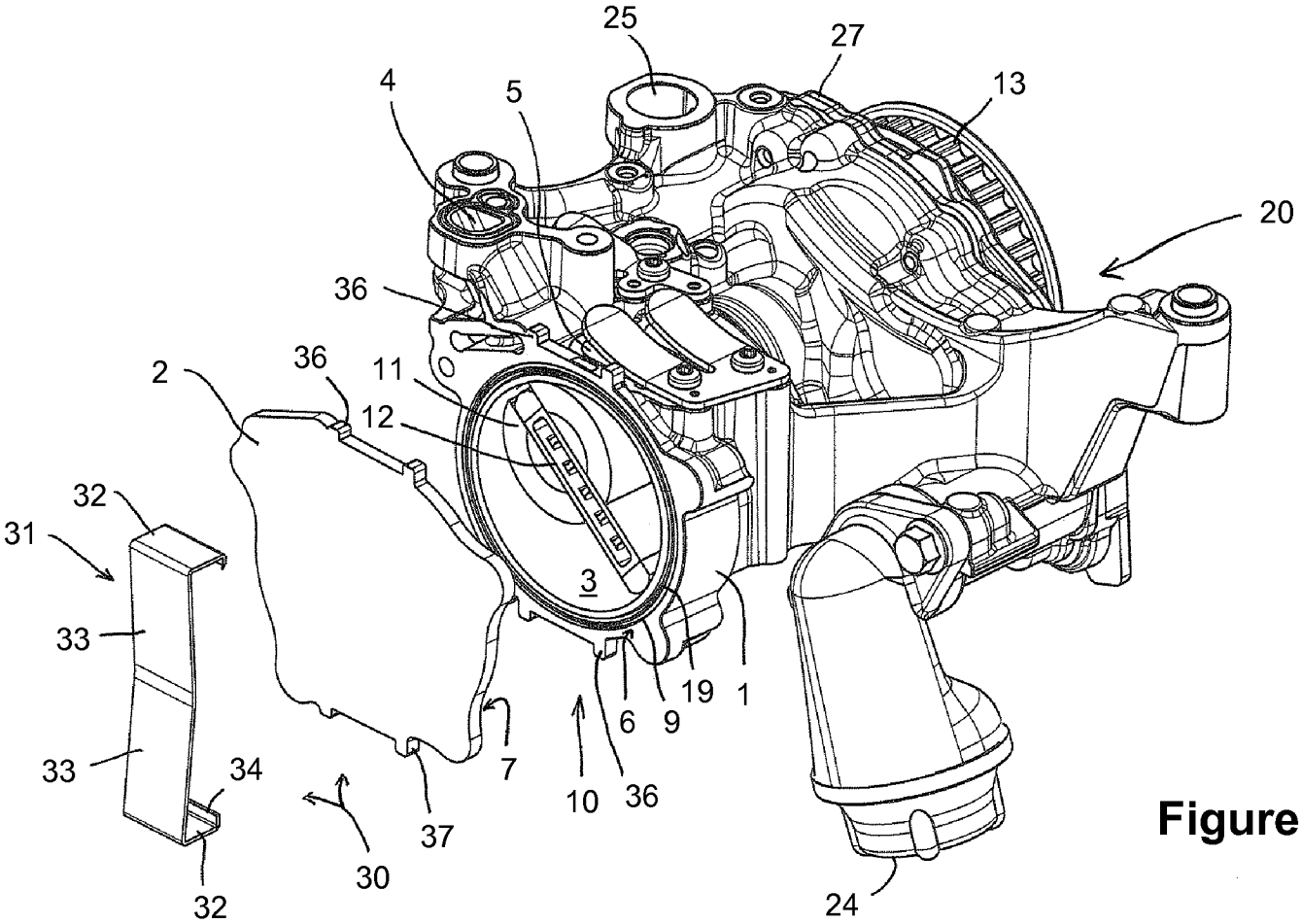
FIG. 1 illustrates a pump unit comprising a gas pump of a first example embodiment, in an isometric view onto the gas pump.

FIG. 1 shows a pump unit comprising a gas pump 10 of a first example embodiment and a liquid pump 20, in an isometric view onto the gas pump 10. The pump unit comprises a housing which is common to both pumps 10 and 20. Such arrangements of pumps are also referred to as a tandem arrangement. The common housing comprises: a housing part 1 which mounts moving components of the pump unit, in particular a delivery device of the gas pump 10 and a delivery device of the liquid pump 20, such that they can be moved; a housing part 2 which forms a cover of the gas pump 10; and a housing part 27 which forms a cover of the liquid pump 20. The housing part 1 is formed—expediently, cast—in one piece. In principle, however, it can instead also be joined from a plurality of pieces. The housing parts 2 and 27 are each formed from metal in one piece and joined to the housing part 1, for example by means of a screw connection in each case, as shown.

The gas pump 10 and the liquid pump 20 are embodied as rotary pumps. The rotary pumps 10 and 20 are arranged coaxially, one axially behind the other, along a common rotational axis. The housing part 1 is axially arranged centrally. The housing part 2 is arranged on one axial front face of the housing part 1, and the housing part 27 is arranged on the other axial front face of the housing part 1.

The delivery device of the gas pump 10 comprises a delivery rotor 11, which can be rotated about the rotational axis, and a single vane 12 which is coupled to the delivery rotor 11 in a way which transmits torque. The delivery device is correspondingly single-vaned. The delivery rotor 11 radially guides the vane 12, such that it can be shifted. In the region of the gas pump 10, the housing part 1 forms a housing cup which limits a delivery chamber 3, on a front face of the chamber which axially faces the liquid pump 20, and surrounds the delivery chamber 3 over the circumference of the chamber. When the delivery rotor 11 is rotary-driven, the vane 12 revolves in the delivery chamber 3 and divides the delivery chamber 3 into a delivery cell which increases in size on a low-pressure side of the gas pump 10 and another delivery cell which decreases in size on a high-pressure side of the gas pump 10. The increase in the size of the delivery cell causes gas to be suctioned on the low-pressure side through an inlet 4 into the enlarging delivery cell and then expelled through an outlet 5 on the high-pressure side when the delivery cell decreases in size. The gas pump 10 can in particular be operated as a negative pressure pump or vacuum pump in order for example to supply a brake servo of a vehicle with negative pressure. In such an application, the brake servo or another or an additional assembly of the vehicle which is to be supplied with negative pressure is connected to the inlet 4, and the suctioned gas—preferably, air—is expelled into the environment via the outlet 5, for example into a crankcase of an internal combustion engine, wherein a lubricant which serves to lubricate the delivery device 10 is simultaneously also expelled through the outlet 5.

The housing part 2 seals the delivery chamber 3 on one front face. FIG. 1 shows the housing part 2 before it is mounted, in a position in which the housing part 2 lies axially opposite the facing open front face of the housing part 1 and then has only to be axially pressed against and fixedly connected to the housing part 1 in order to seal the delivery chamber 3. Once they have been joined, a sealing surface 6 of the housing part 1 which axially faces the housing part 2 and a sealing surface 7 of the housing part 2 which axially faces the housing part 1 abut each other axially and form a sealing join which extends around the delivery chamber 3, in order to seal off the delivery chamber 3 over its circumference. In the sealing surface 6, a groove-shaped sealing recess 9 is formed over the entire circumference of the delivery chamber 3. A sealing element 19, for example a sealing ring, is arranged in the sealing recess 9 and elastically pressed when the housing parts 1 and 2 are joined, thus ensuring that the sealing join is sealed off as is required. Alternatively, the sealing join between the sealing surfaces 6 and 7 can however also be ensured by a sealing liquid situated in the sealing recess 9. In such embodiments, the sealing recess 9 is filled with the sealing liquid at least during pump operations. An elastic sealing ring or other sealing element is not then required in order to seal off the sealing join.

Figure 2:
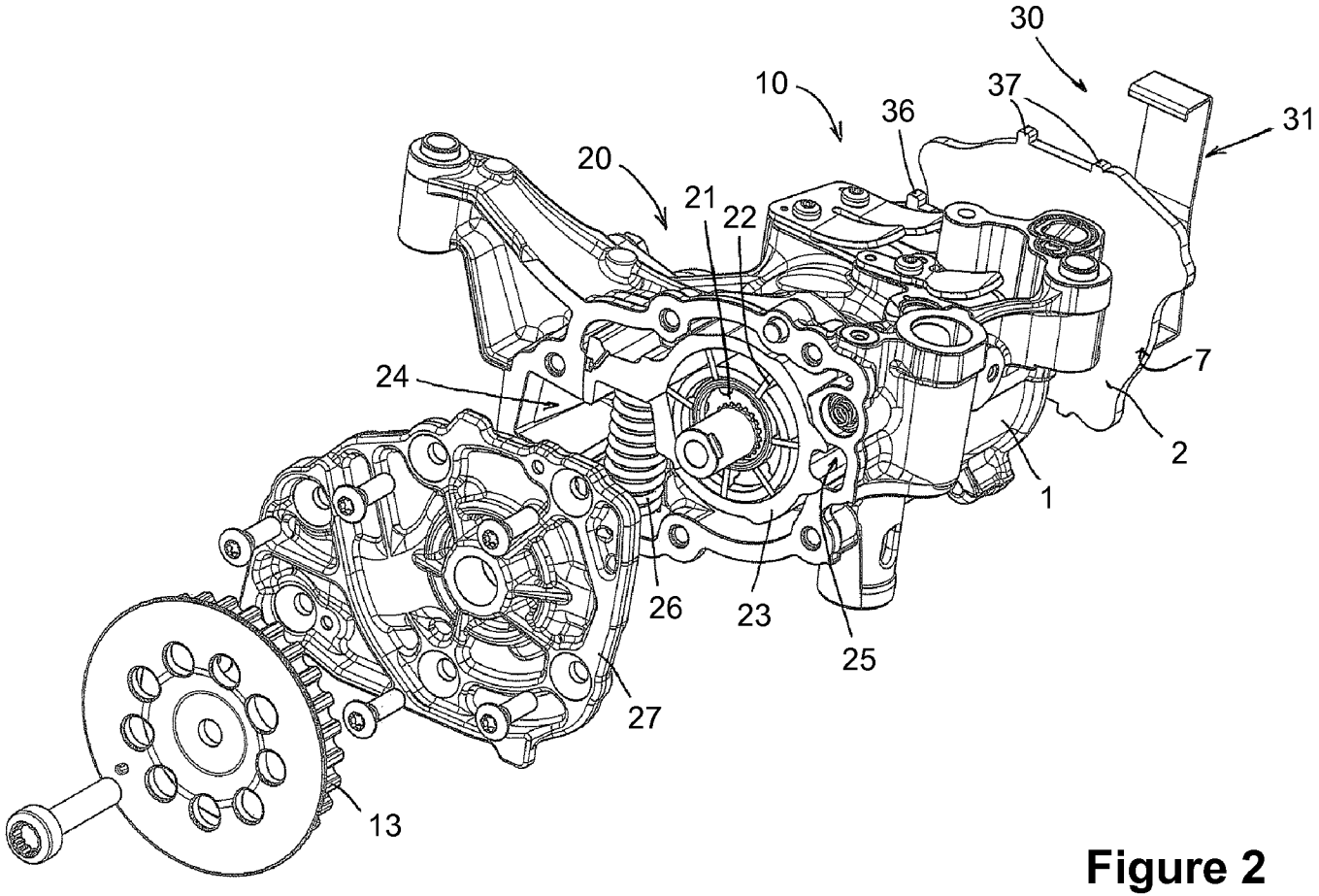
FIG. 2 illustrates the pump unit of the first example embodiment, in an isometric view onto a liquid pump of the arrangement.

FIG. 2 shows the pump unit of the first example embodiment, in an isometric view onto the liquid pump 20. The liquid pump 20, like the gas pump 10, is a vane cell pump. Unlike the gas pump 10, the liquid pump 20 comprises a multi-vaned delivery device featuring a delivery rotor 21, which can be rotated about the rotational axis which it has in common with the gas pump 10, and a plurality of vanes 22 which are arranged in a distribution over the circumference of the delivery rotor 21. The liquid pump 20 can be adjusted in terms of its specific delivery volume. It comprises a setting ring 23 which is mounted such that it can be pivoted relative to the housing part 1, in order to be able to adjust an eccentricity of the delivery device 21, 22 and therefore the specific delivery volume of the liquid pump 20. A restoring spring 26 exerts a restoring force, which acts in the direction of a maximum delivery volume, on the setting ring 23. The pressure liquid delivered by the liquid pump 20 is applied to the setting ring 23 in the direction of reducing the specific delivery volume, i.e. acting counter to said restoring force. The vanes 22 sub-divide a delivery chamber of the liquid pump 20 into delivery cells which increase in size on a low-pressure side of the delivery chamber when the delivery device 21, 22 is rotary-driven and the setting ring 23 is positioned eccentrically relative to the rotational axis, thus suctioning fluid into the delivery chamber, and which decrease in size again on a high-pressure side of the delivery chamber, such that the liquid is expelled at an increased pressure through an outlet 25 on the high-pressure side. In FIG. 2, the entire inlet region on the low-pressure side of the liquid pump 20 is indicated by 24, and the entire outlet region on the high-pressure side is indicated by 25. The inlet region comprises an inlet 24 of the housing part 1, which can be seen in FIG. 1, and an inlet portion 24 which is located in the housing part 1 upstream of the delivery chamber and in which the restoring spring 26 is for example arranged and from which a chamber inlet leads directly into the delivery chamber. The outlet region comprises: the chamber outlet, which leads directly out of the delivery chamber; an outlet portion 25 which is formed in the housing part 1; and, downstream of the outlet portion 25, an outlet 25 of the housing part 1.

The liquid pump 20 can in particular be a lubricant pump for supplying an assembly with a liquid lubricant. In preferred applications, the liquid pump 20 is a lubricant pump for supplying a combustion engine, preferably a drive motor of a vehicle, with liquid lubricant.

The pump unit is rotary-driven via a drive wheel 13. If the pump unit is assigned to a combustion engine, it can for example be driven by a crankshaft of the combustion engine via the drive wheel 13. The drive wheel 13 can be a component of a traction means gear system or also a component of a toothed wheel gear system or in principle also a component of a friction wheel gear system. The drive wheel 13 is mechanically coupled to both the delivery device 11, 12 and the delivery device 21, 22 and can in particular be non-rotationally connected to both delivery rotors 11 and 21.

The pump unit can be partially or completely immersed in a sump or other type of reservoir of a liquid fluid, in particular a reservoir of the fluid which is delivered by the liquid pump 20. The pump unit can then be arranged in a lower region of a combustion engine, for example on a lower side of the combustion engine, such that it is partially or completely immersed in the lubricant sump of the combustion engine. Arranging it in a liquid reservoir, preferably a lubricant reservoir, is advantageous for sealing off the gas pump. Due to the negative pressure prevailing in the delivery chamber 3 during pump operations, lubricant is able and allowed to be suctioned, up to a certain extent, from the environment—the reservoir—via the sealing join 6, 7 into the sealing recess 9 and from there into the delivery chamber 3. The lubricant which surrounds the gas pump on the outside and which can optionally also simultaneously serve as a sealing fluid, effectively prevents ambient air from being suctioned via the sealing join 6, 7 in the region surrounded by the lubricant, thus enabling the strength of seal on the gas pump and therefore its effectiveness and delivery rate to be improved.

Figure 3:
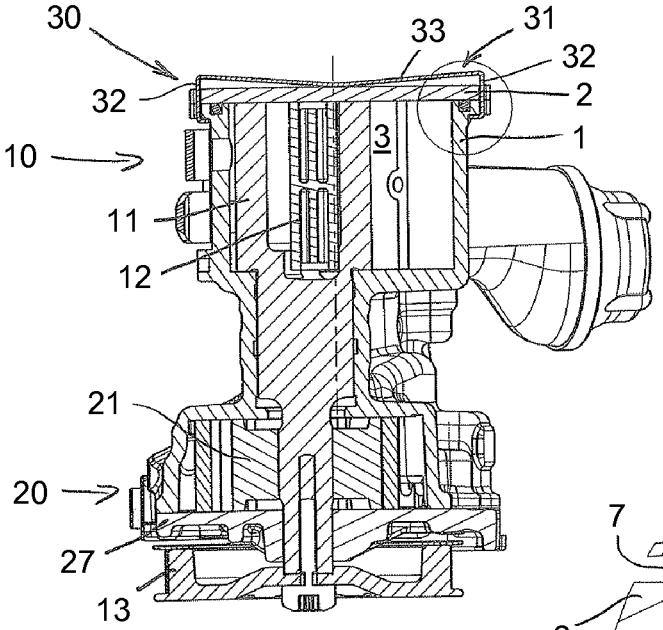
FIG. 3 illustrates the pump unit of the first example embodiment, in a longitudinal section.

FIG. 3 shows the pump unit of the first example embodiment, in a longitudinal section.

Figure 4:
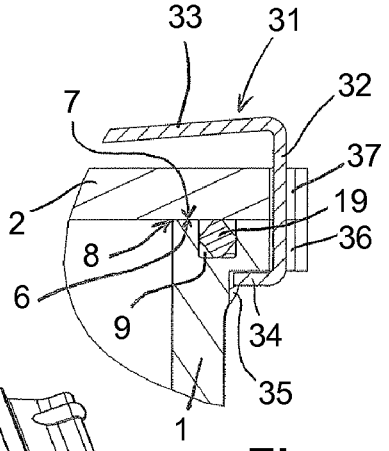
FIG. 4 illustrates a detail of FIG. 3 in an enlarged representation.
Figure 5:
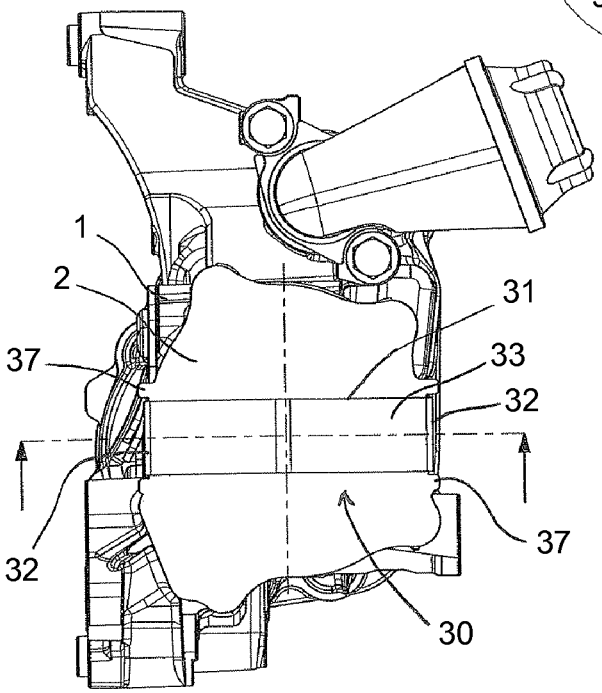
FIG. 5 illustrates the pump unit of the first example embodiment, in an axial view onto the gas pump.

FIGS. 3 to 5 show the pump unit of the first example embodiment in a longitudinal section (FIG. 3), a detail (FIG. 4) and an axial view onto the gas pump 10 (FIG. 5). The housing part 2 is joined to the housing part 1, such that the delivery chamber 3 is closed in a seal and the sealing surfaces 6 and 7 together form the sealing join 8 which surrounds the delivery chamber 3 over its circumference by extending around a central longitudinal axis of the delivery chamber 3. The sealing join 8 is located at an axial end of the delivery chamber 3; in the example embodiment, the sealing surface 6 is a front-facing surface at the open axial end of the housing part 2. The housing part 2 is planar over its front-facing surface which includes the sealing surface 7 and is turned towards the delivery chamber 3. In modifications, the sealing join 8 can for example also be formed at an axially recessed point—a collar surface—of the housing part 1 or in principle also of the housing part 2. Forming the sealing surface 6 at the axial front-facing end of the housing part 1, in combination with the housing part 2 which is planar at least on its side facing the housing part 1, does however facilitate production and thus reduce costs. It should also be noted that the sealing join 8 extends over the entire circumference, i.e. over 360°.

The housing part 2 is pressed against the housing part 1 by means of a pressing device 30, such that the sealing surfaces 6 and 7 abut each other in a seal, forming the sealing join 8. The pressing device 30 is designed such that it allows a movement of the housing part 2 relative to the housing part 1 in a direction pointing axially away from the housing part 1, when an opening force which acts on the housing part 2 in said direction is greater than the pressing force. The opening force can in particular be generated by a positive pressure which prevails in the delivery chamber 3. The pressing device 30 can in particular be configured such that, while the pressing force which it exerts ensures a sufficient seal over the sealing join 8 when the pump is at a stop and during normal delivery operations of the pump, a widening movement is however generated by a positive pressure which arises in the delivery chamber 3 when the pump is started due to the lubricating fluid situated in the delivery chamber 3 and the delivery movement of the delivery device 11, 12. This positive pressure lifts the housing part 2 off the housing part 1, against the restoring pressing force of the pressing device 30, in the region of the sealing join 8, such that the sealing join 8 is widened to form a relieving gap through which excess lubricating liquid situated in the delivery chamber 3 can pass out of the delivery chamber 3 and thus be displaced by the delivery device 11, 12. This reduces the displacement work to be performed and therefore the forces and torques acting on the delivery device 11, 12. Consequently, the circumferential inner contour of the delivery chamber 3 and the vane 12 can be better adapted to each other, in order to enable a gap between the circumferential inner contour and the ends of the vane 12 which is narrower than in the prior art. A reverse rotary valve for relief during reverse rotation can be omitted. Venting provisions, which would reduce the effective delivery rate during normal pump operations, are also unnecessary.

The pressing device 30 is formed entirely as a spring device. It comprises a single, uniform spring member 31 only, which is embodied and arranged as a flexurally stressed spring in order to generate the pressing force. In the example embodiment, the spring member 31 is a leaf spring. It consists of a left-hand and a right-hand spring support region 32 and a spring coupling region 33 which extends from the left-hand to the right-hand spring support region 32. All the spring regions 32 and 33 are formed in one piece from spring steel—in the example, a metal spring sheet. The spring support regions 32 and the spring coupling region 33 together form a spring clip, for example a sheet metal spring clip, such as is known in principle for sealing preserving jars.

The spring member 31 straddles the housing part 2. The spring support regions 32 of the spring member 31 encompass an outer circumference of the housing part 2 and a shoulder of the housing part 1 which protrudes radially outwards. In a central region of the housing part 2, the spring member 31 is coupled to the housing part 2 in order to exert the pressing force, which is generated as a spring force, on the housing part 2 in this central region. In one modification, the spring member 31 can comprise a plurality of spring arms, for example three or four spring arms, which protrude outwards from a central region of the spring member in the direction of the sealing join 8 and in the direction of the housing part 2, in order to apply the spring force to the housing part 2 in a more uniform distribution and closer to the sealing join 8.

The spring coupling region 33 of the spring member 31 is formed so as to be convex in relation to the housing part 2. In the example, it is a metal spring sheet which exhibits a convex profile. The coupling region 33 is shaped as a flat trough. In modifications, the spring coupling region 33 can for example exhibit a contour which is roundly convex throughout or can exhibit the shape of a flat "V". In other words, it bulges out in the direction of the housing part 2 between the spring support regions 32. A region of the spring coupling region 33 which is a front region in the direction of the pressing force presses against the housing part 2. The spring member 31 is mounted with a bias.

In its two spring support regions 32, the spring member 31 bends off from the spring coupling region 33, forming an enclosed acute angle in each case. At the free end of the respective spring support region 32, it bends off again, forming a holding element 34, as can best be seen in FIG. 4. In each of its spring support regions 32, the spring member 31 forms a flat "U", the short end limb of which forms the holding element 34. The holding element 34 of the spring member 31 grips behind the housing part 1 which comprises a holding counter element 35 for the purpose of additional security. Respective pairs of the holding elements 34 and holding counter elements 35 can together form a locking connection. The sharp angular bends can be replaced with more gentle rounded bends. Sharply curved transitions, however, reduce the design space necessary for the pressing device 30 and thus enable a more compact design.

As can be seen in FIG. 4, the sealing element 19 can exhibit a diamond profile, in order for it to be able to be axially expanded over a greater spring path in the course of the widening movement of the housing part 2, but nonetheless does not prevent fluid which is to be displaced from exiting through the sealing join 8. In principle, the sealing element 19 can also have a circular or square profile; it is however preferably elongated orthogonally with respect to the sealing surfaces 6 and 7 and can for example also be oval. This applies to all the embodiments of a gas pump in accordance with the invention which comprises an elastic sealing element such as for example the sealing element 19. In such embodiments, the respective sealing element is also preferably arranged in the sealing recess over the majority of its length, as measured in profile, or is secured in the sealing recess by some other provision, in order to prevent the respective sealing element from being swept along by fluid flowing off from the delivery chamber when the sealing join 8 is widened.

If the pressing force which is predefined by the spring member 31 is exceeded, the housing part 2 can be moved away from the housing part 1, against the restoring pressing force of the spring member 31, as far as an end position which is predefined either by said pressing force or by a mechanical abutment. The spring member 31 can itself form such a mechanical abutment for the housing part 2, if the housing part 2 has not already been held or moved back in the direction of the housing part 1 by the restoring pressing force which increases as the housing part 2 is lifted off. The spring member 31 can in particular form a mechanical abutment in the region of the transition between the spring coupling region 33 and the respective spring support region 32.

During the widening movement, the housing part 2 is guided relative to the housing part 1. This can be performed by the pressing device 30, for example directly by the spring member 31 as in the example embodiment. The spring member 31 fulfils the guiding function by means of its spring support regions 32. The guide can in particular be seen in an overview of FIGS. 4 and 5. The housing parts 1 and 2 form lateral guiding elements 36 and 37 for the spring support regions 32, by each comprising a flat cavity. The spring support regions 32 respectively engage with the assigned cavities, which mutually overlap, in a guiding engagement. The spring support regions 32 are trapped between the guides 36 and 37. The guiding elements 36 of the housing part 1 hold the spring member 31 in position, and the second housing part 2 is axially guided in the region of the side walls of its guiding elements 37 by the spring member 31. In this way, the pressing device 30 fulfils the functions of pressing and guiding the housing part 2 and, in an advantageous development, also the function of an abutment for limiting the widening movement of the housing part 2.

FIGS. 6 to 8 show a pump unit comprising a gas pump 10 of a second example embodiment. The pump unit differs from the first example embodiment in that it has a modified pressing device 40. It otherwise corresponds to the first example embodiment. Aside from the differences described below, reference is therefore made to the statements made with respect to the first example embodiment.

The pressing device 40 comprises one spring member 41 only, as in the first example embodiment, which is likewise formed and arranged as a flexurally stressed spring. Unlike the first example embodiment, however, it is not only the spring member 41 which ensures that the housing part 2 is arranged such that it is sufficiently fixed but flexible for the widening movement. In addition to the spring member 41, the pressing device 40 comprises a fastening device featuring fastening elements 44. The coupling region 43 of the spring member 41 corresponds to that of the spring member 31. The spring support regions 42 connected on the left and right to the outside of the spring coupling region 43 are however shorter and no longer encompass the housing parts 1 and 2. The spring support regions 42 of the spring member 41 are instead supported and also fastened on the housing part 1 by means of the fastening elements 44. As far as the spring action and/or generating and applying the pressing force is concerned, the spring member 41 corresponds to the spring member 31.

One of the two spring support regions 42 is shown in an enlarged representation in FIG. 7. The spring support region 42 of the spring member 41 comprises a passage for the fastening element 44 which can for example be formed as a screw element or extrusion bolt. The fastening element 44 protrudes through first the spring member 41 and then the housing part 2 and into a bore of the housing part 1. It can for example be screwed or pressed in the bore. In a shaft region between the sealing surface 6 and the spring support region 42, the fastening element 44 is also surrounded by a sleeve-shaped guiding element 45 which also protrudes into the passage formed in the housing part 2 for the fastening element 44 and exhibits a certain clearance with respect to the housing part 2 in the region of the passage. The clearance is dimensioned such that the housing part 2 is guided by the guiding engagement 45 during a widening movement, but the guiding engagement 45 does not obstruct the widening movement. Instead of an additional guiding element 45, the fastening element 44 could also guide the housing part 2 directly in the corresponding shaft region. Tribologically, however, the use of an additional guiding element 45 is advantageous.

As can also be directly seen in FIG. 8, the housing part 2 is held in its mounted position relative to the housing part 1 by the plurality of mutually spaced fastening and guiding points—in the example embodiment, two fastening and guiding points—such that it can only perform the widening movement and the corresponding closing movement.

FIGS. 9 to 11 show a pump unit comprising a gas pump 10 and a liquid pump 20 in a third example embodiment which is derived from the second example embodiment and differs from the latter only in its pressing device 50, such that in order to describe the pressing device 50, reference is also made to the second example embodiment, and such that reference is also otherwise again made to the first example embodiment, in particular to the descriptions given with respect to the pressing device 30.

The pressing device 50 comprises a plurality of separate spring members 51; four spring members 51 have been chosen by way of example. The spring members 51 each comprise a spring support region 52 and a spring coupling region 53 which is connected to the spring support region 52, wherein the spring support region 52 of each of the spring members 51 respectively presses against the housing part 2, in order to press the housing part 2, in the region of its sealing surface 7, against the sealing surface 6 of the housing part 1, as can be seen in particular in the detail in FIG. 10.

The spring support regions 52 of the spring members 51 are respectively supported and fastened on the housing part 1 by means of a fastening element 54. Sleeve-shaped guiding elements 55 again ensure that the housing part 2 is axially guided and also positioned. The fastening elements 54 and the guiding elements 55 correspond at least substantially to the fastening elements 44 and the guiding elements 45, such that reference is made to the second example embodiment with regard to supporting and fastening the spring members 51 and guiding the housing part 2.

In order to more reliably ensure that the spring members 51 retain their intended position during pump operations, the fastening elements 54 and the passages which protrude through them can be formed so to as conform to each other in the spring support regions 52, such that they co-operate to form a rotational block for the respective spring member 51. This is shown in FIG. 11 for the lower spring member 51 only, by way of example for the other spring members 51 also.

Figure 12:
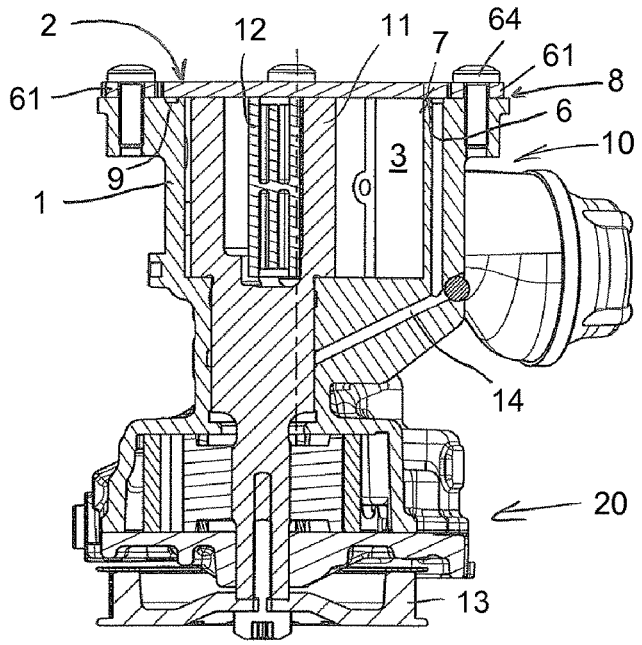
FIG. 12 illustrates a pump unit comprising a gas pump of a fourth example embodiment, in a longitudinal section.
Figure 13:
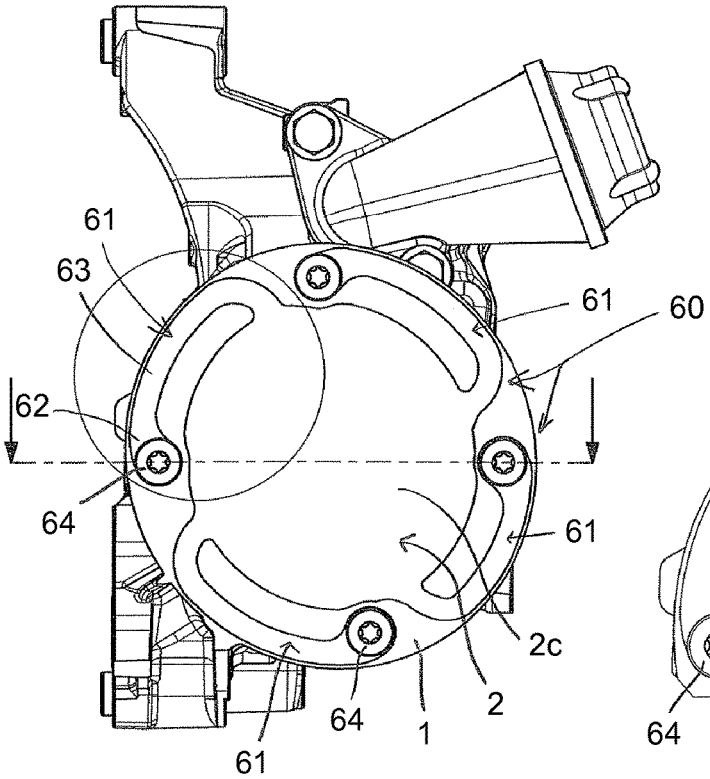
FIG. 13 illustrates the pump unit of the fourth example embodiment, in an axial view onto the gas pump.
Figure 14:
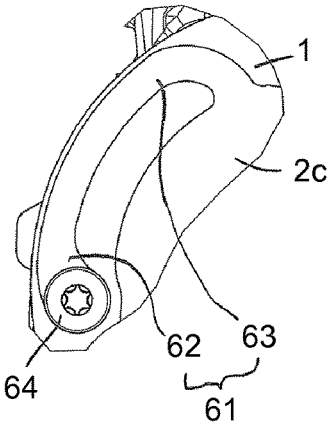
FIG. 14 illustrates a detail of FIG. 13 in an enlarged, detailed representation.

FIGS. 12 to 14 show a pump unit of a fourth example embodiment, featuring a modified pressing device 60. One characteristic feature of the fourth example embodiment is that the spring members 61 of the pressing device 60 are a fixed component of the housing part 2. In this sense, they are integrated spring members 61.

In the fourth example embodiment, the housing part 2 comprises a central housing part base structure 2*c* which is rigid in its own right, and the spring members 61 which project outwards from the housing part base structure 2*c* over its periphery. The spring members 61 are each formed in the shape of a spring arm. The spring arms first project slightly outwards from the housing part base structure 2*c*. Each of the short spring arm portions is connected to a comparatively longer spring arm portion which transitions into a spring support region 62 of the respective spring member 61 at an end facing away from the short spring arm portion. In this way, each of the spring members 61 comprises a spring coupling region 63 which projects freely from the central housing part base structure 2*c* and extends at least substantially in a circumferential direction over the majority of its length. As mentioned, the spring support regions 62 are arranged at the ends of the spring coupling regions 63. In the spring support regions 62, the spring members 61 are each fixed, such that they cannot be moved, relative to the housing part 1. In the top view of FIGS. 13 and 14, the spring members 61 are at least substantially C-shaped and each comprise an at least substantially L-shaped spring coupling region 63.

The housing part base structure 2*c* comprises the sealing surface 7 on its inner or lower side facing the housing part 1, in order to form the sealing join 8 of the fourth example embodiment with the axially facing sealing surface 6. The sealing join 8 extends along the periphery of the housing part base structure 2*c* and—in the top view of FIG. 13—radially within the spring members 61.

The housing part base structure 2*c* and the spring members 61 are formed in one piece, for example cast from a metallic material, and as applicable machine-finished, or preferably punched from a sheet of metal, in particular steel, or formed by means of another separating process. As can be seen in the top view of FIG. 13, the housing part 2 and the integrated spring members 61 together form a sinuous spring, the sinuous arms of which are the spring members 61. The spring members 61 are flexurally stressed springs in the form of sinuous arms.

The housing part base structure 2*c* can be axially biased against the sealing surface 6 of the housing part 1 by the spring members 61. To this end, the lower side of the spring members 61 can comprise a clear distance from the facing front face of the housing part 1, by being slightly recessed there relative to the sealing surface 7 of the housing part 2 (FIG. 12). This enables the housing part 2 to be fastened on the housing part 1 with a bias.

In the fourth example embodiment, an elastic sealing element such as for example the sealing element 19 (FIG. 4) has been omitted. Instead, the sealing recess 9 is filled with a sealing fluid, which can in particular be formed by the lubricating fluid for the gas pump 10, at least during pump operations. The lubricating fluid can be the fluid which is delivered by the liquid pump 20. Accordingly, a feed channel 14 can be seen in FIG. 12, through which the sealing recess 9 is supplied with the sealing fluid, preferably the lubricating fluid. It is also possible for the respective sealing recess 9 in the other example embodiments to be filled with sealing fluid and for an elastic sealing element to be omitted. Conversely, it is also possible for the fluid seal in the fourth example embodiment to be replaced with an elastic sealing element arranged in the sealing recess 9. With regard to sealing off using a sealing fluid and to supplying the sealing recess 9 with a sealing fluid, reference is made to German patent application No. 10 2012 222 753.9 which is also incorporated by reference in this respect.

The gas pump of the fourth example embodiment and indeed the entire pump unit otherwise corresponds to that of the first example embodiment.

FIGS. 15 to 17 show a pump unit of a fifth example embodiment. In this pump unit, a gas pump 10 and a liquid pump 20 are again combined to form a mounting unit. Aside from a pressing device 70 which has again been modified, the pump unit corresponds to the previous example embodiments, such that reference is again made to the statements made with respect to the first example embodiment.

As in the third example embodiment (FIGS. 9 to 11), the pressing device 70 comprises a plurality of spring members 71. The spring members 71 are not however flexurally stressed spring members as in the other example embodiments, but rather a torsionally stressed spring member 71 in each case, for example a helical pressure spring in each case. The spring members 71 are each fixedly connected to the housing part 1 by means of a fastening element 74 which respectively protrudes through them. They each comprise a spring support region 72 at their ends facing away from the housing parts 1 and 2, and a spring coupling region 73 facing the housing part 2, as can best be seen in FIG. 16. They are each biased, such that when the pump is at a stop, they exert a biasing force—and correspondingly, in total, the pressing force—on the housing part 2. As in the third example embodiment, the spring members 71 are arranged in a distribution along the sealing join 8, such that aside from the opening and closing movement, they position and fix the housing part 2 relative to the housing part 1 and co-operate to apply the pressing force, necessary for sealing the delivery chamber 3, to the housing part 2.

Aside from the differences described, reference is made to the statements made with respect to the other example embodiments.

In the example embodiments, an axial block on the delivery rotor 11 and also the vane 12 is omitted. In one modification, the respective delivery rotor 11 and/or the respective vane 12 can be axially secured in order to prevent the delivery rotor or the vane from being axially moved, which can cause a clanging noise, during a widening movement of the housing part 2.

REFERENCE SIGNS

1 housing part
2 housing part
2*a* guiding element
2*b* holding element
2*c* housing part base structure
3 delivery chamber
4 inlet
5 outlet
6 sealing surface
7 sealing surface
8 sealing join

9 sealing recess
10 gas pump
11 delivery rotor
12 vane
13 drive wheel
14 feed channel
15 -
16 -
17 -
18 -
19 sealing element
20 liquid pump
21 delivery rotor
22 vane
23 setting ring
24 inlet, inlet region
25 outlet, outlet portion, outlet region
26 restoring spring
27 -
28 -
29 -
30 pressing device
31 spring member
32 spring support region
33 spring coupling region
34 holding element
35 holding counter element
36 guiding element
37 guiding element
38 -
39 -
40 pressing device
41 spring member
42 spring support region
43 spring coupling region
44 fastening element
45 guiding element
46 -
47 -
48 -
49 -
50 pressing device
51 spring member
52 spring support region
53 spring coupling region
54 fastening element
55 guiding element
56 -
57 -
58 -
59 -
60 pressing device
61 spring member
62 spring support region
63 spring coupling region
64 fastening element
65 -
66 -
67 -
68 -
69 -
70 pressing device
71 spring member
72 spring support region
73 spring coupling region
74 fastening element
75 guiding element

What is claimed is:

1. A vacuum vane cell pump, comprising:

a delivery chamber comprising an inlet and an outlet for a gas;

at least one delivery rotor comprising one or more vanes arranged in the delivery chamber, and which is moveable within the delivery chamber, for delivering the gas;

a first housing part comprising a first sealing surface which at least partially surrounds the delivery chamber;

a second housing part comprising a second sealing surface which at least partially surrounds the delivery chamber, wherein the second housing part together with the first housing part at least partially enclose the delivery chamber; and a pressing device comprising a leaf spring which presses one of the first or second housing parts against the other with a pressing force, such that the first and second sealing surfaces abut each other and together form a sealing join which at least partially surrounds the delivery chamber, in order to seal off the delivery chamber;

wherein the second housing part is moveable relative to the first housing part, against the pressing force, in order to be able to widen the sealing join to form a relieving gap through which lubricating liquid situated in the delivery chamber can escape into the environment, the lubricating liquid serving to lubricate and seal off the vacuum vane cell pump is, and wherein the pressing device is configured such that widening of the sealing join begins automatically when a predetermined maximum pressure in the delivery chamber is exceeded when the vacuum vane cell pump is started and during a first revolution of the vacuum vane cell pump and the sealing join is closed automatically by the pressing device when the pressure inside the delivery chamber is reduced to or below said maximum pressure and a negative pressure which prevails in the delivery chamber relative to the environment of the vacuum vane cell pump during pump operations assists the pressing force;

wherein the outlet for the gas of the delivery chamber is connected to the environment and wherein the gas is air;

wherein the relieving gap connects the delivery chamber to the environment of the vacuum vane cell pump; and wherein the vacuum vane cell pump is a negative pressure pump for supplying a brake servo of a vehicle with negative pressure, the brake servo being connected to the inlet of the vacuum vane cell pump, and suctioned gas is expelled into the environment via the outlet of the vacuum vane cell pump, the environment being a crankcase of an internal combustion engine of the vehicle.

2. The vacuum vane cell pump according to claim 1, wherein the pressing device comprises a first spring member which generates a first spring force which forms at least a part of the pressing force.

3. The vacuum vane cell pump according to claim 2, wherein the first spring member is a flexurally stressed spring.

4. The vacuum vane cell pump according to claim 2, wherein the first spring member is supported in a spring support region and coupled to the second housing part in a spring coupling region.

5. The vacuum vane cell pump according to claim 4, wherein the first spring member acts in its spring coupling region on the second housing part in the direction of the pressing force.

6. The vacuum vane cell pump according to claim 4, wherein the first spring member is also supported in an additional spring support region and in that the spring coupling region extends between the spring support regions.

7. The vacuum vane cell pump according to claim 4, wherein the spring coupling region of the first spring member is convex in relation to the second housing part and exhibits a spring bias which acts on the second housing part in the direction of the pressing force.

8. The vacuum vane cell pump according to claim 2, wherein the second housing part comprises a housing part base structure which comprises the second sealing surface, and the first spring member projects from the housing part base structure and is fixedly connected to the housing part base structure.

9. The vacuum vane cell pump according to claim 8, wherein the first spring member and the housing part base structure are formed in one piece together.

10. The vacuum vane cell pump according to claim 2, wherein the pressing device comprises a second spring member for generating an additional spring force, wherein the sum of the first spring force and the additional spring force form at least a part of the pressing force, and in that the first and second spring members are supported on mutually spaced points of the first housing structure or are coupled to the second housing structure at mutually spaced points of the second housing structure.

11. The vacuum cell pump according to claim 10, wherein the second housing part comprises a housing part base structure which comprises the second sealing surface, and in that the first spring member and the second spring member project from the housing part base structure and are fixedly connected to the housing part base structure.

12. The vacuum vane cell pump according to claim 10, wherein the second housing part is fastened on the first housing part by the first spring member or the second spring member.

13. The vacuum vane cell pump according to claim 2, wherein a guide is provided which extends in the direction in which the second housing part can be moved, and the second housing part is guided along the guide when it is moved, wherein a portion of the first spring member forms the guide.

14. The vacuum vane cell pump according to claim 1, wherein a sealing recess extends around the delivery chamber in at least one of the sealing surfaces which form the sealing join, wherein the sealing recess is filled with a sealing fluid at least while the vacuum vane cell pump is in operation, in order to seal off the delivery chamber on the outside, such that a seal by means of an additional sealing ring can be omitted.

15. The vacuum vane cell pump according to claim 1, wherein a movement of the second housing part in a direction which widens the sealing join is limited by a fixed abutment.

16. The vacuum vane cell pump according to claim 15, wherein the pressing device comprises a spring member and the spring member forms the fixed abutment.

17. The vacuum vane cell pump according to claim 1, wherein the pressing device is supported on the first housing part or on a third housing part of the vacuum vane cell pump or on a mounting unit which comprises the vacuum vane cell pump, and acts on the second housing part such that the pressing force is completely absorbed by the first or third housing parts or the mounting unit.

18. The vacuum vane cell pump according to claim 1, wherein the vacuum vane cell pump is connected to a lubricant circuit for lubricating one or more assemblies of a vehicle, and wherein the liquid is the lubricant for lubricating the one or more assemblies.

19. The vacuum vane cell pump according to claim 1, wherein the pressing device is elastically flexible over a spring path which is at least as large as a maximum gap width of the relieving gap.

20. A pump unit comprising the vacuum vane cell pump according to claim 1 and a lubricant pump which serves to supply a combustion engine with a liquid lubricant, the liquid lubricant forming the sealing fluid for the vacuum vane cell pump, wherein the lubricant pump comprises a delivery chamber with an inlet on a low-pressure side of the lubricant pump and an outlet on a high-pressure side of the lubricant pump for the liquid lubricant, and a delivery device which can be driven and which can perform a delivery movement in the delivery chamber when driven, which delivers the liquid lubricant from the inlet to the outlet of the delivery chamber of the lubricant pump;

the lubricant pump furthermore comprises a housing part which forms one or more chamber walls of the delivery chamber of the lubricant pump; and the first housing part of the vacuum vane cell pump simultaneously also forms the housing part of the lubricant pump.

21. The pump unit according to claim 20 comprising a housing which is common to the vacuum vane cell pump and the lubricant pump, this common housing comprising:

the first housing part which mounts moving components of the pump unit, including the delivery rotor of the vacuum vane cell pump and the delivery device of the lubricant pump, such that they can be moved;

the second housing part which forms a cover of the vacuum vane cell pump; and a third housing part which forms a cover of the lubricant pump.

22. The pump unit according to claim 20, wherein the pump unit is partially immersed in a sump of the liquid lubricant.

23. The pump unit according to claim 20, wherein the pump unit is arranged on a lower side of a combustion engine and partially immersed in a sump of the liquid lubricant, the sump being the lubricant sump of the combustion engine.

24. A negative pressure system of a vehicle, comprising:

a brake servo to be supplied with a negative pressure a pump comprising a delivery chamber comprising an inlet and an outlet for a gas, wherein the inlet of the pump is connected to the brake servo in order to supply it with a negative pressure;

a first housing part comprising a first sealing surface which at least partially surrounds the delivery chamber;

a second housing part comprising a second sealing surface which at least partially surrounds the delivery chamber, wherein the second housing part together with the first housing part at least partially encloses the delivery chamber;

a delivery device, which can be moved within the delivery chamber, for delivering the negative pressure for the brake servo; and a pressing device comprising a leaf spring which presses one of the housing parts against the other with a pressing force, such that the first and the second sealing surfaces abut each other and together form a sealing join which at least partially surrounds the delivery chamber, in order to seal off the delivery chamber;

wherein the second housing part is moveable relative to the first housing part, against the pressing force, in order to be able to widen the sealing join to form a relieving gap through which lubricating liquid situated in the delivery chamber can escape into the environment, the lubricating liquid serving to lubricate and seal off the pump;

wherein the pressing device is configured to allow for discharge of excess fluid inside the pump by the delivery device when the pump is started and during a first revolution of the pump;

wherein the negative pressure which prevails in the delivery chamber relative to the environment of the pump during pump operations assists the pressing force;

wherein the outlet for gas of the delivery chamber is connected to the environment and wherein the gas is air;

wherein the relieving gap connects the delivery chamber to the environment of the pump; and wherein suctioned gas is expelled via the outlet of the pump into a crankcase of an internal combustion engine of the vehicle.

25. The system according to claim 24, wherein the pump is a vane cell pump comprising a rotor with at least one vane.

26. A pump unit comprising a vacuum vane cell pump and a lubricant pump, the vacuum vane cell pump comprising:

a delivery chamber comprising an inlet and an outlet for a gas;

at least one delivery rotor comprising one or more vanes arranged in the delivery chamber, and which is moveable within the delivery chamber, for delivering the gas;

a first housing part comprising a first sealing surface which at least partially surrounds the delivery chamber;

a second housing part comprising a second sealing surface which at least partially surrounds the delivery chamber, wherein the second housing part together with the first housing part at least partially enclose the delivery chamber; and a pressing device comprising a leaf spring which presses one of the first or second housing parts against the other with a pressing force, such that the first and second sealing surfaces abut each other and together form a sealing join which at least partially surrounds the delivery chamber, in order to seal off the delivery chamber;

wherein the second housing part is moveable relative to the first housing part, against the pressing force, in order to be able to widen the sealing join to form a relieving gap through which lubricating liquid situated in the delivery chamber can escape into the environment, the lubricating liquid serving to lubricate and seal off the vacuum vane cell pump, and wherein the pressing device is configured such that widening of the sealing join begins automatically when a predetermined maximum pressure in the delivery chamber is exceeded when the vacuum vane cell pump is started and during a first revolution of the vacuum vane cell pump and the sealing join is closed automatically by the pressing device when the pressure inside the delivery chamber is reduced to or below said maximum pressure and a negative pressure which prevails in the delivery chamber relative to the environment of the vacuum vane cell pump during pump operations assists the pressing force;

wherein the outlet for the gas of the delivery chamber is connected to the environment and wherein the gas is air;

wherein the relieving gap connects the delivery chamber to the environment of the vacuum vane cell pump;

wherein the vacuum vane cell pump is a negative pressure pump for supplying a brake servo of a vehicle with negative pressure;

the lubricant pump serving to supply a combustion engine with a liquid lubricant, the liquid lubricant forming the sealing fluid for the vacuum vane cell pump, wherein the lubricant pump comprises a delivery chamber with an inlet on a low-pressure side of the liquid pump and an outlet on a high-pressure side of the lubricant pump for the liquid lubricant, and a delivery device which can be driven and which can perform a delivery movement in the delivery chamber when driven, which delivers the liquid lubricant from the inlet to the outlet of the delivery chamber of the lubricant pump;

the pump unit comprising a housing which is common to the vacuum vane cell pump and the lubricant pump, this common housing comprising:

the first housing part which simultaneously also forms one or more chamber walls of the delivery chamber of the lubricant pump and mounts the delivery rotor of the vacuum vane cell pump and the delivery device of the lubricant pump such that they can be moved;

the second housing part which forms a cover of the vacuum vane cell pump; and a third housing part which forms a cover of the lubricant pump;

wherein the second housing part and the third housing part are each joined to the first housing part.

27. A vacuum vane cell pump, comprising:

a delivery chamber comprising an inlet and an outlet for a gas;

at least one delivery rotor comprising one or more vanes arranged in the delivery chamber, and which is moveable within the delivery chamber, for delivering the gas;

a first housing part comprising a first sealing surface which at least partially surrounds the delivery chamber;

a second housing part comprising a second sealing surface which at least partially surrounds the delivery chamber, wherein the second housing part together with the first housing part at least partially enclose the delivery chamber; and a pressing device which presses one of the first or second housing parts against the other with a pressing force, such that the first and second sealing surfaces abut each other and together form a sealing join which at least partially surrounds the delivery chamber, in order to seal off the delivery chamber;

wherein the second housing part is moveable relative to the first housing part, against the pressing force, in order to be able to widen the sealing join to form a relieving gap through which lubricating liquid situated in the delivery chamber can escape into the environment, the lubricating liquid serving to lubricate and seal off the vacuum vane cell pump, and wherein the pressing device is configured such that widening of the sealing join begins automatically when a predetermined maximum pressure in the delivery chamber is exceeded when the vacuum vane cell pump is started and during a first revolution of the vacuum vane cell pump and the sealing join is closed automatically by the pressing device when the pressure inside the delivery chamber is reduced to or below said maximum pressure and a negative pressure which prevails in the delivery chamber relative to the environment of the vacuum vane cell pump during pump operations assists the pressing force;

wherein the outlet for the gas of the delivery chamber is connected to the environment and wherein the gas is air;

wherein the relieving gap connects the delivery chamber to the environment of the vacuum vane cell pump;

wherein the vacuum vane cell pump is a negative pressure pump for supplying a brake servo of a vehicle with negative pressure;

wherein the pressing device comprises a flexurally stressed spring member which generates a spring force which forms the pressing force;

wherein the spring member is supported in a spring support region and acts in a spring coupling region on the second housing part in the direction of the pressing force;

wherein the spring member is also supported in an additional spring support region and the spring coupling region extends between the spring support regions; and wherein the spring coupling region of the spring member is convex in relation to the second housing part and exhibits a spring bias which acts on the second housing part in the direction of the pressing force.

* * * * *